US007872420B2

(12) United States Patent
Kawasaki et al.

(10) Patent No.: US 7,872,420 B2
(45) Date of Patent: Jan. 18, 2011

(54) CERAMIC METAL HALIDE LAMP HAVING RATED LAMP WATTAGE BETWEEN 450 W AND 1500W WITHOUT FLICKER

(75) Inventors: Kazuhiko Kawasaki, Kyoto (JP); Shinji Taniguchi, Kyoto (JP); Kuniaki Nakano, Kyoto (JP)

(73) Assignee: GS Yuasa International Ltd., Kyoto-shi (JP)

( * ) Notice: Subject to any disclaimer, the term of this patent is extended or adjusted under 35 U.S.C. 154(b) by 711 days.

(21) Appl. No.: 11/816,198

(22) PCT Filed: Feb. 17, 2006

(86) PCT No.: PCT/JP2006/302826
§ 371 (c)(1),
(2), (4) Date: Aug. 14, 2007

(87) PCT Pub. No.: WO2006/088128

PCT Pub. Date: Aug. 24, 2006

(65) Prior Publication Data

US 2009/0072741 A1 Mar. 19, 2009

(30) Foreign Application Priority Data

Feb. 17, 2005 (JP) ..... 2005-041009

(51) Int. Cl.
*H01J 61/36* (2006.01)
*H01J 17/18* (2006.01)

(52) U.S. Cl. ..... 313/621; 313/567

(58) Field of Classification Search ..... None
See application file for complete search history.

(56) References Cited

U.S. PATENT DOCUMENTS

| | | | |
|---|---|---|---|
| 5,831,388 | A | 11/1998 | Genz et al. |
| 6,555,962 | B1 | 4/2003 | Jackson et al. |
| 2003/0025453 | A1 | 2/2003 | Kakisaka et al. |
| 2004/0104677 | A1 | 6/2004 | Kakisaka et al. |
| 2004/0189207 | A1 | 9/2004 | Miura et al. |
| 2004/0263080 | A1 | 12/2004 | Brates et al. |

FOREIGN PATENT DOCUMENTS

| | | | |
|---|---|---|---|
| JP | 963538 | A | 3/1997 |
| JP | 2003217508 | A | 7/2003 |
| JP | 2003526888 | A | 9/2003 |
| JP | 2004111373 | A | 4/2004 |
| JP | 2004319447 | A | 11/2004 |
| JP | 2005-19387 | A | 1/2005 |
| JP | 2003272560 | A | 8/2007 |

OTHER PUBLICATIONS

International Search Report of PCT/JP2006/302826, date of mailing Apr. 4, 2006.

*Primary Examiner*—Toan Ton
*Assistant Examiner*—Britt D Hanley
(74) *Attorney, Agent, or Firm*—Westerman, Hattori, Daniels & Adrian, LLP

(57) ABSTRACT

In a metal halide lamp having a rated lamp wattage of greater than or equal to 450 W, which includes: a translucent ceramic arc tube enclosure including: a main tube inside which a discharge space is formed; and two narrow tubes having smaller diameter than the main tube, each connected to either end of the main tube; two electrodes; and a metal halide provided inside the arc tube enclosure, in which one of the two electrodes is disposed so that it protrudes inside the main tube from inside of one of the two narrow tubes, and the other one of the two electrodes is disposed so that it protrudes inside the main tube from the other one of the two narrow tubes, and when the rated lamp wattage is denoted by W (watt), an inside diameter of the main tube by D (mm), an electrode protruding length which is the distance from boundary between the main tube and the narrow tubes to an end of the electrode by L (mm), and the distance between ends of the two electrodes by E (mm), a bulb wall loading G (watt/cm$^2$) represented by $G=W/(3.14\times D\times E\times 0.01)$ falls within the range of $15\leqq G\leqq 40$, and a relationship $0.32\leqq L/D\leqq 0.0003\times W+0.465$ is established.

4 Claims, 6 Drawing Sheets

CERAMIC METAL HALIDE LAMP HAVING RATED LAMP WATTAGE BETWEEN 450 W AND 1500W WITHOUT FLICKER

TECHNICAL FIELD

The present invention relates to a ceramic metal halide lamp in which a ceramic tube of a translucent alumina ceramic or the like is used as an arc tube member.

BACKGROUND ART

In recent years, metal halide lamps in which a translucent ceramic is used instead of translucent quartz as an arc tube member have been widely used. Translucent ceramic materials such as a translucent alumina ceramic has the advantage of excellent corrosion resistivity at high temperature against a metal halide which is a filler of the metal halide lamp, compared to conventional translucent quartz materials. Therefore, when a ceramic is used as an arc tube member, it is possible to improve luminous efficacy and color rendering of the lamp by setting arc tube temperature high during operation.

However, ceramic materials such as an alumina ceramic have a drawback that they are more fragile to thermal shock than quartz materials. This is because the coefficient of thermal expansion of ceramics is larger than that of quartz. For example, the coefficient of thermal expansion of quartz glass is about $0.5\times10^{-6}$/° C., while the coefficient of thermal expansion of alumina ceramics is about $8\times10^{-6}$/° C. in the temperature range of 0 to 900° C. Thus, the coefficient of thermal expansion of alumina ceramics is about one digit larger than that of quartz.

As such a metal halide lamp using translucent ceramics such as alumina ceramics in an arc tube (hereinafter, referred to as ceramic metal halide lamp), those having a rated lamp wattage of not more than 400 W have been brought into practice. The term "rated lamp wattage" used herein represents typical power consumption of lamps declared in catalogue or the like.

However, a metal halide lamp having a rated lamp wattage of greater than or equal to 450 W has not been brought into practice. This is because of the aforementioned characteristic of a ceramic material, namely, being more fragile to thermal shock than quartz materials. Accordingly, in attempting implementation of a ceramic metal halide lamp having a rated lamp wattage of greater than or equal to 450 W, a problem arises that the ceramic arc tube cracks due to rapid increase in arc tube temperature during operation of the lamp.

Japanese Unexamined Patent Publication No. 2003-086130 proposes one measure for solving the above problem of cracking of an arc tube in a ceramic metal halide lamp having large lamp power. FIG. 5 is a section view of an arc tube of the ceramic metal halide lamp disclosed in the above publication. In FIG. 5, the numeral 21 denotes an electrode, 22 denotes an electricity introducing member, 23 denotes an arc tube (translucent ceramic tube), 24 denotes a narrow tube, 27 denotes a second coil, and 28 denotes a sealing material.

In this publication, the arc tube 23 made of a translucent ceramic in which cerium iodide and potassium iodide are enclosed as luminescent substances is provided; the molar composition ratio of the luminescent substances $NaI/CeI_3$ is set within the range of 3.8 to 10; and Le/D is defined in the ranges of 0.75 to 1.70, 0.80 to 1.80, 0.85 to 1.90, 1.00 to 2.00 and 1.15 to 2.10 at the lamp watt of 200 W, 300 W, 400 W, 700 W and 1000 W, respectively, when assuming an electrode-to-electrode distance as Le, and a tube inner diameter of the arc tube as D within the range of a bulb wall loading we of the arc tube of 13 to 23 W/cm$^2$, whereby the arc tube is prevented from cracking.

[Patent document 1] Japanese Unexamined Patent Publication No. 2003-86130

DISCLOSURE OF THE INVENTION

Problems to be Solved by the Invention

We made a ceramic metal halide lamp having a rated lamp wattage of greater than or equal to 450 W as a trial in accordance with the description of Japanese Unexamined Patent Publication No. 2003-086130 and conducted a operating test of the lamp, to reveal that there arises the problems of instable arc and occurrence of early blacking of the arc tube. Instable arc and occurrence of flicker describe the state that the arc between electrodes fluctuates or meanders and the velocity of change in intensity of light emitted from the lamp is smaller than the responding velocity of human eyes to the light, so that light and dark is felt against the light emitted from the lamp. Since flicker of a lamp gives uncomfortable feel to human eyes, such a lamp is unsuitable for general lighting uses. These demonstrate that setting Le/D within the above ranges is not sufficient for the requirement to make a ceramic metal halide lamp having a rated lamp wattage of greater than or equal to 450 W into practical use.

The present invention was made in view of the above problems, and it is an object of the present invention to provide a ceramic metal halide lamp having a rated lamp wattage of not less than 450 W, which will not cause flicker due to instable arc during operating of the lamp and early blacking of an arc tube.

Means for Solving the Problems

In a ceramic metal halide lamp having a rated lamp wattage of not more than 400 W, flicker never occurred within the range of conventional general design. The present invention was devised based on the first understanding that flicker is likely to occur only when the rated lamp wattage is greater than or equal to 450 W. That is, the present invention solves the problem of likelihood of occurrence of flicker, which specifically arises when the rated lamp wattage is greater than or equal to 450 W.

For achieving the above object, a first aspect of the present invention is a metal halide lamp having a rated lamp wattage of greater than or equal to 450 W, which comprises: a translucent ceramic arc tube enclosure including: a main tube inside which a discharge space is formed; and two narrow tubes having smaller diameter than the main tube, each connected to either end of the main tube; two electrodes; and a metal halide provided inside the arc tube enclosure, wherein one of the two electrodes is disposed so that it protrudes inside the main tube from inside of one of the two narrow tubes, and the other one of the two electrodes is disposed so that it protrudes inside the main tube from the other one of the two narrow tubes, and when the rated lamp wattage is denoted by W (watt), an inside diameter of the main tube by D (mm), an electrode protruding length which is the distance from boundary between the main tube and the narrow tubes to an end of the electrode by L (mm), and the distance between ends of the two electrodes by E (mm), a bulb wall loading G (watt/cm$^2$) represented by $G=W/(3.14\times D\times E\times 0.01)$ falls within the range of $15\leqq G\leqq 40$, and a relationship $0.32\leqq L/D\leqq 0.0003\times W+0.465$ is established.

In a second aspect of the present invention, a relationship of $L/D \geqq 0.0001 \times W + 0.405$ is established among the W, the D and the L.

Since the present invention is designed as described above, the following effects are provided.

According to the first aspect of the invention, advantageously even in a ceramic metal halide lamp having a rated lamp wattage of greater than or equal to 450 W, almost no flicker occurs, and early blacking does not occur in the arc tube.

According to the second aspect of the invention, advantageously even in a ceramic metal halide lamp having a rated lamp wattage of greater than or equal to 450 W, completely no flicker occurs, and early blacking does not occur in the arc tube.

EXPLANATION OF REFERENCE NUMERALS

| | |
|---|---|
| 1 | main tube |
| 2 | narrow tube |
| 3 | electrode core |
| 4 | first coil |
| 5 | second coil |
| 6 | first heat-resistant metal wire |
| 7 | second heat-resistant metal wire |
| 8 | ceramic sleeve |
| 9 | sealing material |
| 11 | arc tube |
| 12 | outer bulb |
| 13 | starter |
| 14 | support wire |
| 15 | metallic ignition aid |
| 16 | getter |
| 17 | base |
| 21 | electrode |
| 22 | electricity introducing member |
| 23 | arc tube (translucent ceramic tube) |
| 24 | narrow tube |
| 27 | second coil |
| 28 | sealing material |

BEST MODE FOR CARRYING OUT THE INVENTION

Figure 1:
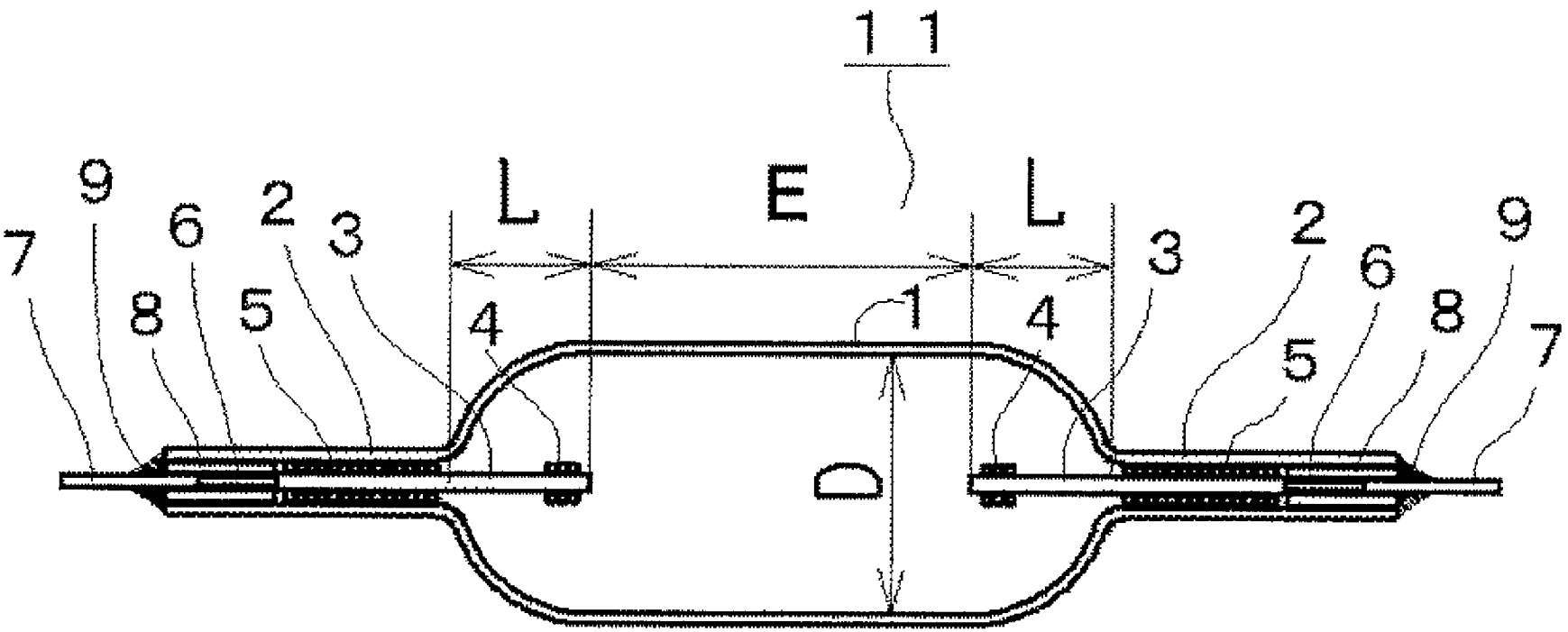
FIG. 1 is a section view showing a makeup of an arc tube in a metal halide lamp according to a first embodiment of the present invention.

Preferred embodiments of the present invention will be explained with reference to drawings based on Examples. In FIG. 1, the numeral 11 denotes an arc tube. The arc tube 11 includes a main tube 1 implemented by a translucent ceramic tube, which forms inside thereof a discharge space with a size corresponding to the diameter in its center part thereof, and narrow tubes 2 having a reduced diameter located in each end.

An electricity introducing member and a ceramic sleeve 8 are inserted inside the narrow tube 2, and secured by a sealing material 9. The sealing material 9 keeps inside of the narrow tube 2 hermetical to the outside. The electricity introducing member is made up of electrodes, a first heat-resistant metal wire 6, and a second heat-resistant metal wire 7. The electrodes include an electrode core 3, a first coil 4 in the main tube 1, and a second coil 5 in the narrow tube 2. The electrode core 3, the first heat-resistant metal wire 6, and the second heat-resistant metal wire 7 are connected sequentially as shown in FIG. 1.

As a material of the translucent ceramic tube, alumina, yttria or the like is used. The shape of the translucent ceramic tube is not limited to the shape shown in FIG. 1 which has a tubular center part and narrowed end parts. For example, as shown in FIG. 3, the entirety of the main tube 1 may form a curved surface, or as shown in FIG. 4, the entirety of the main tube 1 may be tubular.

Figure 3:
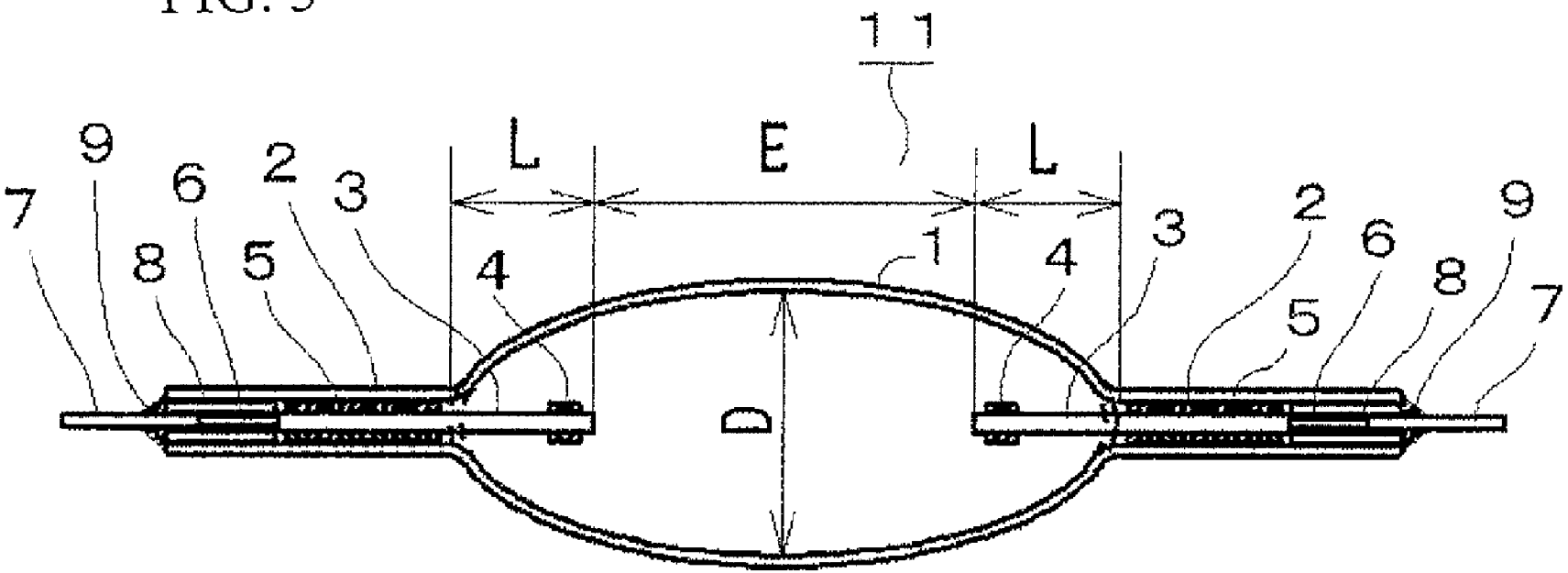
FIG. 3 is a section view showing a makeup of an arc tube in a metal halide lamp according to a second embodiment of the present invention.
Figure 4:
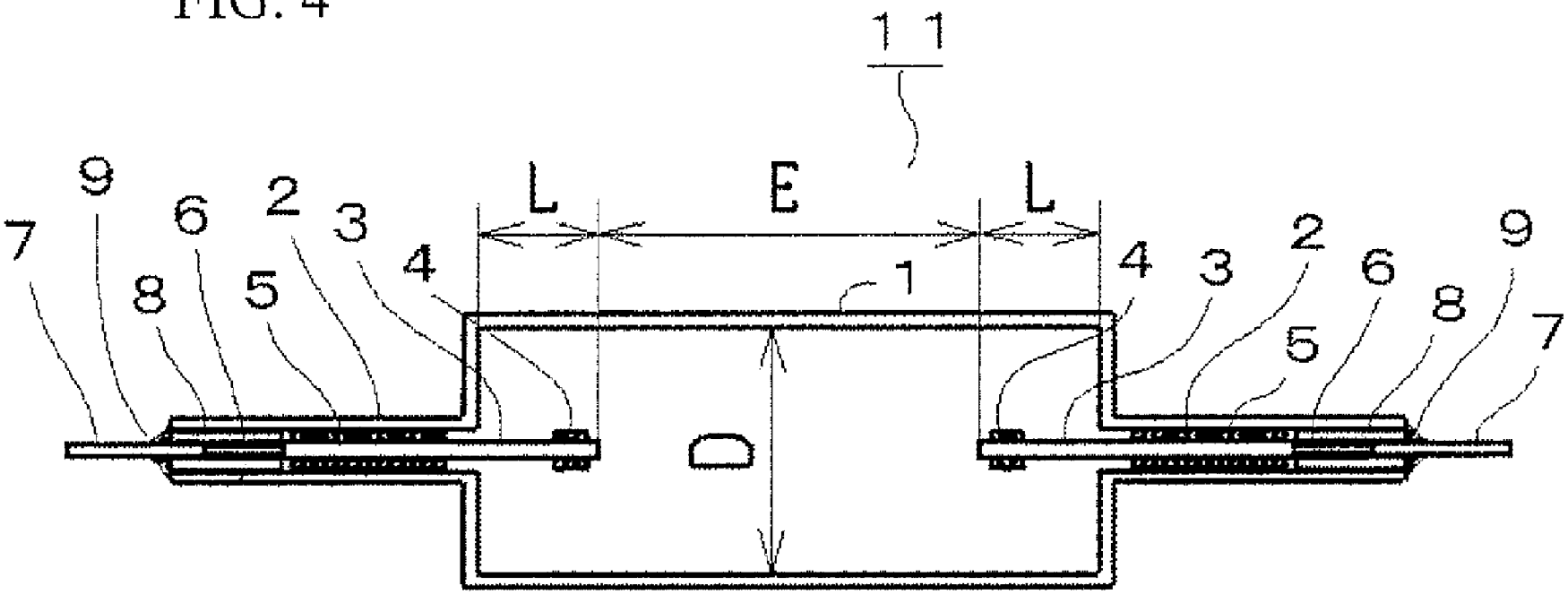
FIG. 4 is a section view showing a makeup of an arc tube in a metal halide lamp according to a third embodiment of the present invention.
Figure 5:
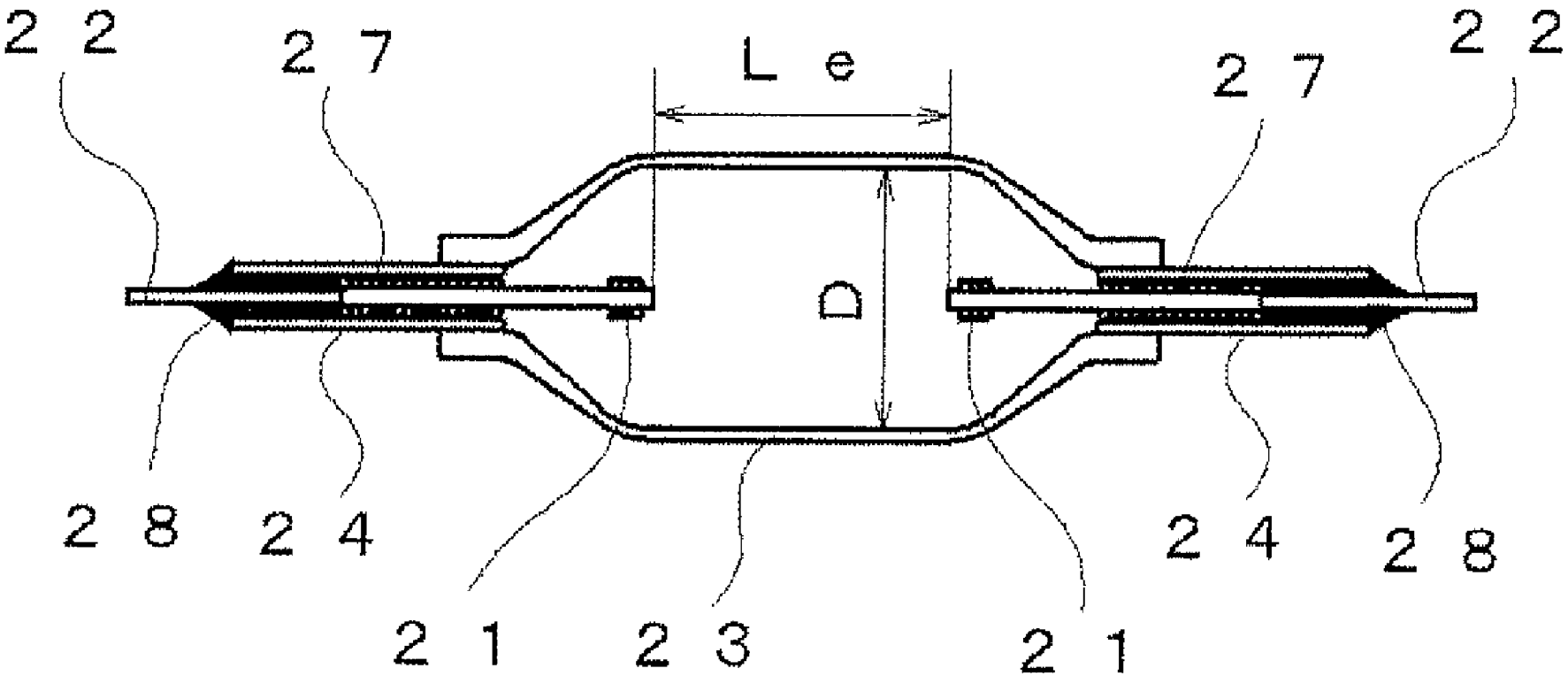
FIG. 5 is a section view showing a makeup of an arc tube in an alumina ceramic tube metal halide lamp according to a conventional technique.

When the inside diameter of the main tube 1 varies depending on the position as shown in FIG. 3, the inside diameter D of the main tube is represented by the maximum diameter. In the case of the example shown in FIG. 3, the actual bulb wall loading assumes a somewhat different value from that shown in the formula $G=W/(3.14 \times D \times E \times 0.01)$. In a practical shape of the main tube 1, however, since the value of G calculated from the above formula, and an actual value of the bulb wall loading do not largely differ, it can be conveniently considered in the present invention that the bulb wall loading is determined by the above formula. When the entirety of the main tube 1 is tubular, as shown in FIG. 4, or when a part of the main tube 1 is tubular as shown in FIG. 1, the inner diameter D of the main tube is an inner diameter of each tubular part.

The sealing material 9 is charged from an end part of the narrow tube 2 to such a position that it covers a part of the first heat-resistant metal wire 6. As a material of the sealing material 9, for example, an $Al_2O_3$—$SiO_2$—$Dy_2O_3$ based material is used as one having corrosion resistivity against a metal halide. As the first heat-resistant metal wire 6, molybdenum or its alloy having corrosion resistivity against a metal halide is used. As the second heat-resistant metal wire 7, niobium, tantalum or an alloy thereof having a similar coefficient of thermal expansion to those of the narrow tube 2 and the sealing material 9 is used. Alternatively a conductive cermet made of a mixed sintered body of a metal powder and an alumina powder may be used in place of the heat-resistive metal wire 6 and the heat-resistive metal wire 7.

As the materials for the first coil 4 and the electrode core 3, a heat-resistant metal such as tungsten is used. For the second coil 5, a heat-resistant metal such as molybdenum is used, and the second coil 5 serves to prevent a luminous metal from sinking down.

In the arc tube 11 thus designed, a noble gas serving as a starting gas, a metal halide for generating light by discharge, and mercury serving as a buffer gas are enclosed. As the noble gas, argon gas, xenon gas or the like is used. As the metal halide, halides of sodium, thallium, calcium and tin, or halides of various rare-earth metals may be used. Particularly preferred rare-earth metals are Tm, Ho, Dy and the like.

Figure 2:
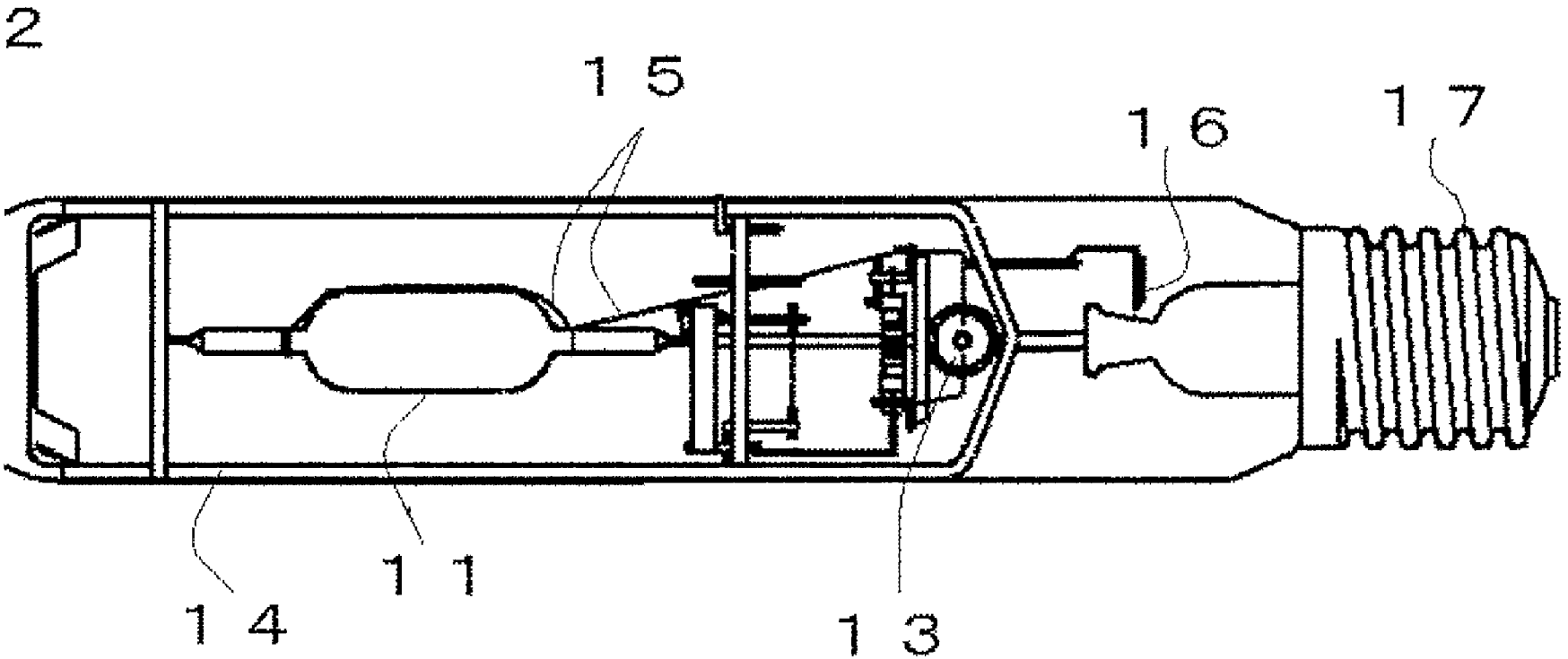
FIG. 2 is a section view showing a makeup of the entire lamp of a metal halide lamp of the present invention.

In the completed lamp, as shown in FIG. 2, the arc tube 11 is secured inside the outer bulb 12 made of hard glass via a support wire 14 which also serves as a lead wire made of, e.g., stainless. To the arc tube 11, a metallic ignition aid 15 made from a thin wire of molybdenum or the like is attached. The metallic ignition aid 15 is applied with one of potentials via a bimetal switch (not shown) and serves to improve starting performance of the lamp.

To the outer bulb 12, a starter 13 implemented by a glow starter is connected and secured in parallel with the arc tube 11. By incorporating the starter 13 within the outer bulb 12, operating at a ballast for mercury lamp is possible. It is not necessary to incorporate the starter 13 in the outer bulb 12, however, a special ballast incorporating a starter is required in such a case. The inside of the outer bulb 12 is made into vacuum or charged with an inert gas. When the inside of the bulb 12 is made into vacuum, a getter 16 formed of, e.g., barium is attached so that high vacuum is maintained over the life time of the lamp. The lamp thus designed is equipped with a base 17.

An operation principle of the metal halide lamp thus designed will be now described. When a power supply is connected to the base 17 of the metal halide lamp via the ballast (not shown), voltages are applied to the starter 13 and the arc tube 11. Once voltage is applied to the starter 13, a contact of the glow starter repeats ON and OFF, and high-pressure pulse is generated accordingly in the ballast. Since the high-pressure pulse generated in the ballast is applied across the electrodes on both ends of the arc tube 11, the lamp starts operating.

Inventors of the present invention carefully examined a relationship between a bulb wall loading G, an electrode protruding length L and an inside diameter of main tube D in FIG. 1, and lamp characteristics for determining a specific configuration of the arc tube 11 made of ceramic in a lamp having a rated lamp wattage of greater than or equal to 450 W. The results will be explained below based on Examples. In this context the electrode protruding length L is represented by a distance from a boundary between the main tube 1 and the narrow tubes 2, to an end of the electrode, and the boundary between the main tube 1 and the narrow tubes 2 is defined by the position where an inside diameter of the narrow tube 2 extends to 1.1 when the inside diameter of the narrow tube 2 is defined as 1.0.

EXAMPLES

As for 450 W

In designing an arc tube of a lamp having a rated lamp wattage of greater than or equal to 450 W, a relationship between an inside diameter of main tube D and a luminous flux maintenance factor, as well as a relationship between a bulb wall loading G, and efficacy and a general color rendering index Ra were examined. A material for the arc tube 11 used in this examination was a translucent polycrystalline alumina ceramic. In the arc tube 11, 5.0 μmol/cc of NaI, 0.5 μmol/cc of of T1I, 0.6 μmol/cc of $TmI_3$, 0.5 μmol/cc of $HoI_3$, 0.6 μmol/cc of $DyI_3$, and 10 kPa of an argon gas as a starting noble gas were enclosed. Mercury was used as a buffer gas, and the enclosing amount of mercury was adjusted depending on the set values of the inside diameter of main tube D and the bulb wall loading G for adapting the lamp voltage to a certain value. Results of these tests are shown in Table 1 and Table 2.

Table 1 shows a relationship between the bulb wall loading, and efficacy and the general color rendering index Ra at an inside diameter of main tube D of 21 mm and at a constant L/D of 0.45. Lamp characteristics are represented by values at the operating at a constant lamp wattage of 450 W. Such value is an average of three lamps. The result demonstrates that both of the characteristics, efficacy and Ra are excellent when the bulb wall loading is set within the range of 15 to 40 W/cm$^2$, more preferably within the range of 20 to 35 W/cm$^2$.

TABLE 1

| Bulb wall loading W/cm$^2$ | Efficacy lm/W | Ra |
|---|---|---|
| 10 | 70 | 75 |
| 15 | 90 | 81 |
| 20 | 98 | 85 |
| 25 | 100 | 85 |
| 35 | 97 | 86 |
| 40 | 92 | 87 |
| 45 | 81 | 90 |

Table 2 shows a relationship between the inside diameter of main tube D and the luminous flux maintenance factor after operating for 5000 hours at a lamp wattage of 450 W at a bulb wall loading of 25 W/cm$^2$ and a constant L/D of 0.45. Each value is shown by an average of three lamps. The result shows that a preferred range of the inside diameter of main tube D is from 18 to 24 mm from the viewpoint of the luminous flux maintenance factor.

TABLE 2

| D (mm) | Luminous flux maintenance factor (%) |
|---|---|
| 15 | 68 |
| 18 | 80 |
| 21 | 80 |
| 24 | 80 |
| 27 | 72 |

Next, a relationship between the electrode protruding length L and the inside diameter of main tube D, and characteristics of lamp (flicker and blacking of arc tube) was examined. In this case, the inside diameter of main tube D was set at values of an upper limit and a lower limit of a preferred range, and the bulb wall loading G was set at an optimum value of 25 W/cm$^2$. The material of the arc tube and the kind and amount of the filler were the same as those used in the previous test.

Specifications of the lamp used in the test, and characteristics after operating the lamp at 450 W for about 5000 hours are shown in Table 3. The result demonstrates that the range of L/D, where almost no flicker occurs and blacking of the arc tube does not occur, is from 0.32 to 0.60, inclusive. It is also demonstrated that the range of L/D, where absolutely no flicker occurs and no blacking of the arc tube occurs, is from 0.45 to 0.60, inclusive. A relationship between occurrence of blacking of the arc tube, and the luminous flux maintenance factor was generally as shown below.

Blacking observed maintenance factor: less than 80%

Blacking not observed maintenance factor: 80% or greater

TABLE 3

| | D (mm) | L (mm) | L/D | Flicker | Arc tube blacking |
|---|---|---|---|---|---|
| Comparative Example 1 | 18 | 5.4 | 0.30 | Observed | Observed |
| Example 1 | 18 | 5.8 | 0.32 | Almost unobserved | Unobserved |
| Example 2 | 18 | 6.3 | 0.35 | Almost unobserved | Unobserved |
| Example 3 | 18 | 8.1 | 0.45 | Completely unobserved | Unobserved |

TABLE 3-continued

| | D (mm) | L (mm) | L/D | Flicker | Arc tube blacking |
|---|---|---|---|---|---|
| Example 4 | 18 | 9.9 | 0.55 | Completely unobserved | Unobserved |
| Example 5 | 18 | 10.8 | 0.60 | Completely unobserved | Unobserved |
| Comparative Example 2 | 18 | 11.3 | 0.63 | Completely unobserved | Observed |
| Comparative Example 3 | 24 | 7.2 | 0.30 | Observed | Observed |
| Example 6 | 24 | 7.7 | 0.32 | Almost unobserved | Unobserved |
| Example 7 | 24 | 8.4 | 0.35 | Almost unobserved | Unobserved |
| Example 8 | 24 | 10.8 | 0.45 | Completely unobserved | Unobserved |
| Example 9 | 24 | 13.2 | 0.55 | Completely unobserved | Unobserved |
| Example 10 | 24 | 14.4 | 0.60 | Completely unobserved | Unobserved |
| Comparative Example 4 | 24 | 15.1 | 0.63 | Completely unobserved | Observed |

<As for 700 W>

In designing an arc tube of a lamp having a rated lamp wattage of greater than or equal to 700 W, a relationship between the inside diameter of main tube D and the luminous flux maintenance factor, as well as a relationship between the bulb wall loading G, and efficacy and the general color rendering index Ra were examined. A material for the arc tube 11 used in this examination was a translucent polycrystalline alumina ceramic. In the arc tube 11, 5.0 μmol/cc of NaI, 0.5 μmol/cc of of T1I, 0.6 μmol/cc of $TmI_3$, 0.5 μmol/cc of $HoI_3$, 0.6 μmol/cc of $DyI_3$, and 10 kPa of an argon gas as a starting noble gas were enclosed. Mercury was used as a buffer gas, and the enclosing amount of mercury was adjusted depending on the set values of the inside diameter of main tube D and the bulb wall loading G for adapting the lamp voltage to a certain value. Results of these tests are shown in Table 4 and Table 5.

Table 4 shows a relationship between the bulb wall loading, and efficacy and the general color rendering index Ra at an inside diameter of main tube D of 24 mm and at a constant L/D of 0.50. Lamp characteristics are represented by values at the operating at a constant lamp wattage of 700 W. Such value is an average of three lamps. The result demonstrates that both of the characteristics, efficacy and Ra are excellent when the bulb wall loading is set within the range of 15 to 40 W/cm$^2$, more preferably within the range of 20 to 35 W/cm$^2$.

TABLE 4

| Bulb wall loading W/cm$^2$ | Efficacy lm/W | Ra |
|---|---|---|
| 10 | 73 | 76 |
| 15 | 91 | 82 |
| 20 | 99 | 85 |
| 25 | 102 | 85 |
| 35 | 99 | 86 |
| 40 | 94 | 87 |
| 45 | 88 | 89 |

Table 5 shows a relationship between the inside diameter of main tube D and the luminous flux maintenance factor after operating for 5000 hours at a lamp wattage of 700 W at a bulb wall loading of 25 W/cm$^2$ and a constant L/D of 0.50. Each value is shown by an average of three lamps. The result shows that a preferred range of an inside diameter of main tube D is from 20 to 27 mm from the viewpoint of the luminous flux maintenance factor.

TABLE 5

| D (mm) | Luminous flux maintenance factor (%) |
|---|---|
| 16 | 62 |
| 20 | 80 |
| 24 | 81 |
| 27 | 80 |
| 30 | 72 |

Next, a relationship between the electrode protruding length L and the inside diameter of main tube D, and characteristics of lamp (flicker and blacking of arc tube) was examined. In this case, the inside diameter of main tube D was set at values of an upper limit and a lower limit of a preferred range, and the bulb wall loading G was set at an optimum value of 25 W/cm$^2$. The material of the arc tube and the kind and amount of the filler were the same as those used in the previous test.

Specifications of the lamp used in the test, and characteristics after operating the lamp at 700 W for about 5000 hours are shown in Table 6. The result demonstrates that the range of L/D, where almost no flicker occurs and blacking of the arc tube does not occur, is from 0.32 to 0.67, inclusive. It is also demonstrated that the range of L/D, where absolutely no flicker occurs and no blacking of the arc tube occurs, is from 0.50 to 0.67, inclusive. A relationship between occurrence of blacking of the arc tube, and the luminous flux maintenance factor was generally as shown below.

Blacking observed maintenance factor: less than 80%

Blacking not observed maintenance factor: 80% or greater

TABLE 6

| | D (mm) | L (mm) | L/D | Flicker | Arc tube blacking |
|---|---|---|---|---|---|
| Comparative Example 5 | 20 | 6.0 | 0.30 | Observed | Observed |
| Example 11 | 20 | 6.4 | 0.32 | Almost unobserved | Unobserved |
| Example 12 | 20 | 8.0 | 0.40 | Almost unobserved | Unobserved |
| Example 13 | 20 | 10.0 | 0.50 | Completely unobserved | Unobserved |
| Example 14 | 20 | 12.0 | 0.60 | Completely unobserved | Unobserved |
| Example 15 | 20 | 13.4 | 0.67 | Completely unobserved | Unobserved |
| Comparative Example 6 | 20 | 14.0 | 0.70 | Completely unobserved | Observed |
| Comparative Example 7 | 27 | 8.1 | 0.30 | Observed | Observed |
| Example 16 | 27 | 8.6 | 0.32 | Almost unobserved | Unobserved |
| Example 17 | 27 | 10.8 | 0.40 | Almost unobserved | Unobserved |
| Example 18 | 27 | 13.5 | 0.50 | Completely unobserved | Unobserved |
| Example 19 | 27 | 16.2 | 0.60 | Completely unobserved | Unobserved |
| Example 20 | 27 | 18.1 | 0.67 | Completely unobserved | Unobserved |
| Comparative Example 8 | 27 | 18.9 | 0.70 | Completely unobserved | Observed |

<As for 1000 W>

In designing an arc tube of a lamp having a rated lamp wattage of greater than or equal to 1000 W, a relationship between the inside diameter of main tube D and the luminous flux maintenance factor, as well as a relationship between the bulb wall loading G, and efficacy and the general color rendering index Ra were examined. A material for the arc tube 11 used in this examination was a translucent polycrystalline alumina ceramic. In the arc tube 11, 5.0 μmol/cc of NaI, 0.5 μmol/cc of of T1I, 0.6 μmol/cc of $TmI_3$, 0.5 μmol/cc of $HoI_3$, 0.6 μmol/cc of $DyI_3$, and 10 kPa of an argon gas as a starting noble gas were enclosed. Mercury was used as a buffer gas, and the enclosing amount of mercury was adjusted depending on the set values of the inside diameter of main tube D and the bulb wall loading G for adapting the lamp voltage to a certain value. Results of these tests are shown in Table 7 and Table 8.

Table 7 shows a relationship between the bulb wall loading, and efficacy and the general color rendering index Ra at an inside diameter of main tube D of 27 mm and at a constant L/D of 0.52. Lamp characteristics are represented by values at the operating at a constant lamp wattage of 1000 W. Such value is an average of three lamps. The result demonstrates that both of the characteristics, efficacy and Ra are excellent when the bulb wall loading is set within the range of 15 to 40 W/cm$^2$, more preferably within the range of 20 to 35 W/cm$^2$.

TABLE 7

| Bulb wall loading W/cm$^2$ | Efficacy lm/W | Ra |
|---|---|---|
| 10 | 70 | 75 |
| 15 | 90 | 81 |
| 20 | 98 | 85 |
| 25 | 100 | 85 |
| 35 | 97 | 86 |
| 40 | 92 | 87 |
| 45 | 81 | 90 |

Table 8 shows a relationship between the inside diameter of main tube D and the luminous flux maintenance factor after operating for 5000 hours at a lamp wattage of 1000 W at a bulb wall loading of 25 W/cm$^2$ and a constant L/D of 0.52. Each value is shown by an average of three lamps. The result shows that a preferred range of an inside diameter of main tube D is from 23 to 30 mm from the viewpoint of the luminous flux maintenance factor.

TABLE 8

| D (mm) | Luminous flux maintenance factor (%) |
|---|---|
| 20 | 62 |
| 23 | 80 |
| 27 | 80 |
| 30 | 80 |
| 33 | 69 |

Next, a relationship between the electrode protruding length L and the inside diameter of main tube D, and characteristics of lamp (flicker and blacking of arc tube) was examined. In this case, the inside diameter of main tube D was set at values of an upper limit and a lower limit of a preferred range, and the bulb wall loading G was set at an optimum value of 25 W/cm$^2$. The material of the arc tube and the kind and amount of the filler were the same as those used in the previous test.

Specifications of the lamp used in the test, and characteristics after operating the lamp at 1000 W for about 5000 hours are shown in Table 9. The result demonstrates that the range of L/D, where almost no flicker occurs and blacking of the arc tube does not occur, is from 0.32 to 0.75, inclusive. It is also demonstrated that the range of L/D, where absolutely no flicker occurs and no blacking of the arc tube occurs, is from 0.52 to 0.75, inclusive. A relationship between occurrence of blacking of the arc tube, and the luminous flux maintenance factor was generally as shown below.

Blacking observed maintenance factor: less than 80%

Blacking not observed maintenance factor: 80% or greater

TABLE 9

| | D (mm) | L (mm) | L/D | Flicker | Arc tube blacking |
|---|---|---|---|---|---|
| Comparative Example 9 | 23 | 6.9 | 0.30 | Observed | Observed |
| Example 21 | 23 | 7.4 | 0.32 | Almost unobserved | Unobserved |
| Example 22 | 23 | 9.2 | 0.40 | Almost unobserved | Unobserved |
| Example 23 | 23 | 12.0 | 0.52 | Completely unobserved | Unobserved |
| Example 24 | 23 | 14.7 | 0.64 | Completely unobserved | Unobserved |
| Example 25 | 23 | 17.3 | 0.75 | Completely unobserved | Unobserved |
| Comparative Example 10 | 23 | 18.4 | 0.80 | Completely unobserved | Observed |
| Comparative Example 11 | 30 | 9.0 | 0.30 | Observed | Observed |
| Example 26 | 30 | 9.6 | 0.32 | Almost unobserved | Unobserved |
| Example 27 | 30 | 12.0 | 0.40 | Almost unobserved | Unobserved |
| Example 28 | 30 | 15.6 | 0.52 | Completely unobserved | Unobserved |
| Example 29 | 30 | 19.2 | 0.64 | Completely unobserved | Unobserved |
| Example 30 | 30 | 22.5 | 0.75 | Completely unobserved | Unobserved |
| Comparative Example 12 | 30 | 24.0 | 0.80 | Completely unobserved | Observed |

<As for 1500 W>

In designing an arc tube of a lamp having a rated lamp wattage of greater than or equal to 1500 W, a relationship between the inside diameter of main tube D and the luminous flux maintenance factor, as well as a relationship between the bulb wall loading G, and efficacy and the general color rendering index Ra were examined. A material for the arc tube 11 used in this examination was a translucent polycrystalline alumina ceramic. In the arc tube 11, 5.0 μmol/cc of NaI, 0.5 μmol/cc of of T1I, 0.6 μmol/cc of $TmI_3$, 0.5 μmol/cc of $HoI_3$, 0.6 μmol/cc of $DyI_3$, and 10 kPa of an argon gas as a starting noble gas were enclosed. Mercury was used as a buffer gas, and the enclosing amount of mercury was adjusted depending on the set values of the inside diameter of main tube D and the bulb wall loading G for adapting the lamp voltage to a certain value. Results of these tests are shown in Table 10 and Table 11.

Table 10 shows a relationship between the bulb wall loading, and efficacy and the general color rendering index Ra at an inside diameter of main tube D of 32 mm and at a constant L/D of 0.57. Lamp characteristics are represented by values at the operating at a constant lamp wattage of 1500 W. Such value is an average of three lamps. The result demonstrates that both of the characteristics, efficacy and Ra are excellent when the bulb wall loading is set within the range of 15 to 40 W/cm$^2$, more preferably within the range of 20 to 35 W/cm$^2$.

TABLE 10

| Bulb wall loading W/cm$^2$ | Efficacy lm/W | Ra |
|---|---|---|
| 10 | 70 | 75 |
| 15 | 90 | 81 |
| 20 | 98 | 85 |
| 25 | 100 | 85 |
| 35 | 97 | 86 |
| 40 | 92 | 87 |
| 45 | 81 | 92 |

Table 11 shows a relationship between the inside diameter of main tube D and the luminous flux maintenance factor after operating for 5000 hours at a lamp wattage of 1500 W at a bulb wall loading of 25 W/cm$^2$ and a constant L/D of 0.57. Each value is shown by an average of three lamps. The result shows that a preferred range of an inside diameter of main tube D is from 28 to 35 mm from the viewpoint of the luminous flux maintenance factor.

TABLE 11

| D (mm) | Luminous flux maintenance factor (%) |
|---|---|
| 24 | 62 |
| 28 | 80 |
| 32 | 80 |
| 35 | 80 |
| 38 | 67 |

Next, a relationship between the electrode protruding length L and the inside diameter of main tube D, and characteristics of lamp (flicker and blacking of arc tube) was examined. In this case, the inside diameter of main tube D was set at values of an upper limit and a lower limit of a preferred range, and the bulb wall loading G was set at an optimum value of 25 W/cm$^2$. The material of the arc tube and the kind and amount of the filler were the same as those used in the previous test.

Specifications of the lamp used in the test, and characteristics after operating the lamp at 1500 W for about 5000 hours are shown in Table 12. This result demonstrates that the range of L/D, where almost no flicker occurs and blacking of the arc tube does not occur, is from 0.32 to 0.89, inclusive. It is also demonstrated that the range of L/D, where absolutely no flicker occurs and no blacking of the arc tube occurs, is from 0.57 to 0.89, inclusive. A relationship between occurrence of blacking of the arc tube, and the luminous flux maintenance factor was generally as shown below.

Blacking observed maintenance factor: less than 80%

Blacking not observed maintenance factor: 80% or greater

TABLE 12

| | D (mm) | L (mm) | L/D | Flicker | Arc tube blacking |
|---|---|---|---|---|---|
| Comparative Example 13 | 28 | 8.5 | 0.30 | Observed | Observed |
| Example 31 | 28 | 9.0 | 0.32 | Almost unobserved | Unobserved |
| Example 32 | 28 | 12.0 | 0.43 | Almost unobserved | Unobserved |
| Example 33 | 28 | 16.0 | 0.57 | Completely unobserved | Unobserved |
| Example 34 | 28 | 20.0 | 0.71 | Completely unobserved | Unobserved |
| Example 35 | 28 | 25.0 | 0.89 | Completely unobserved | Unobserved |

TABLE 12-continued

| | D (mm) | L (mm) | L/D | Flicker | Arc tube blacking |
|---|---|---|---|---|---|
| Comparative Example 14 | 28 | 26.0 | 0.93 | Completely unobserved | Observed |
| Comparative Example 15 | 35 | 10.5 | 0.30 | Observed | Observed |
| Example 36 | 35 | 11.2 | 0.32 | Almost unobserved | Unobserved |
| Example 37 | 35 | 16.0 | 0.46 | Almost unobserved | Unobserved |
| Example 38 | 35 | 20.0 | 0.57 | Completely unobserved | Unobserved |
| Example 39 | 35 | 24.0 | 0.69 | Completely unobserved | Unobserved |
| Example 40 | 35 | 31.0 | 0.89 | Completely unobserved | Unobserved |
| Comparative Example 16 | 35 | 33.0 | 0.94 | Completely unobserved | Observed |

From the test results of 450 W, 700 W, 1000 W and 1500 W, the following findings were obtained.

(1) In a lamp having a rated lamp wattage of greater than or equal to 450 W, the bulb wall loading G is relevant to both characteristics of efficacy and the general color rendering index Ra. It is demonstrated that the bulb wall loading G is irrelevant to the size of a lamp, and practical performance is not obtained unless it is within the range between 15 W/cm$^2$ to 40 W/cm$^2$.

(2) In a lamp having a rated lamp wattage of greater than or equal to 450 W, the inside diameter of main tube D is relevant to the luminous flux maintenance factor, and there is an optimum range depending on the size of a lamp. When the lower limit and the upper limit defining the optimum range of the inside diameter of main tube D are denoted by Dmin and Dmax, respectively, the relationship between Dmin and Dmax, and lamp wattage W are represented from the above data by the following linear expressions:

$$D\text{min}=0.0096\times W+13.28 \quad \text{(a)}$$

$$D\text{max}=0.0104\times W+19.72 \quad \text{(b)}$$

Here, formulas (a) and (b) can be determined in the following manner. As for formula (a), first, a relationship between the size of a lamp and the preferred lower limit of the inside diameter of main tube D is determined by a first-order approximation expression. Then, the determined first-order approximation expression is compared with the lower limit of each lamp size, and the first-order approximation expression is translated in parallel so that it passes through the lower limit in the lamp size (herein 700 W) which is farthest in a downward direction from the first-order approximation expression. The linear expression thus obtained by parallel translation of the first-order approximation expression is formula (a) to be determined.

As for formula (b), first, a relationship between the lamp size and the preferred upper limit of the inside diameter of main tube D is determined by a first-order approximation expression. Then, the determined first-order approximation expression is compared with the upper limit of each lamp size, and the first-order approximation expression is translated in parallel so that it passes through the upper limit in the lamp size (herein 700 W) which is farthest in an upward direction from the first-order approximation expression. The linear expression thus obtained by parallel translation of the first-order approximation expression is formula (b) to be determined.

Accordingly the optimum range of the inside diameter of main tube D is represented by $0.0096\times W+13.28 \leqq D \leqq 0.0104\times W+19.72$.

(3) In a lamp having a rated lamp wattage of greater than or equal to 450 W, by increasing the ratio L/D of the electrode protruding length L relative to the inside diameter D of the main tube 11, the arc is stabilized and flicker can be suppressed. A preferred value of the lower limit of L/D is 0.32. This value is irrelevant to the lamp size. When the value of L/D is smaller than the lower limit, flicker of the lamp and early blacking of the arc tube will occur.

On the other hand, an upper limit of the preferred range of L/D (represented by Y) differs depending on the lamp wattage, and is 0.60 at 450 W, 0.67 at 700 W, 0.75 at 1000 W and 0.89 at 1500 W. From these results, the relationship between the upper limit Y of the preferred range of L/D, and lamp wattage W (watt) can be represented by the following linear expression:

$$Y=0.0003\times W+0.465 \quad (c)$$

Here, formula (c) can be determined in the following manner. First, a relationship between lamp wattage W (watt) and the upper limit of the preferred range of L/D of each lamp wattage W is determined by the first-order approximation expression. Then, the determined first-order approximation expression is compared with the upper limit of the preferred range of L/D of each lamp wattage, and the first-order approximation expression is translated in parallel so that it passes through the upper limit in the lamp size (herein 450 W) which is farthest in the upward direction from the first-order approximation expression.

The linear expression thus obtained by parallel translation of the first-order approximation expression is the formula (c) to be determined. When the value of L/D is larger than the upper limit, early blacking will occur in the arc tube. Therefore, the optimum range of L/D is represented by $0.32 \leqq L/D \leqq 0.0003\times W+0.465$.

When the value of L/D falls in the range between the lower limit value and the upper limit value, inclusive, the temperature balance of the arc tube is excellent, and a halogen cycle functions desirably, so that it is possible to reduce early deterioration of the maintenance factor and early blacking of the arc tube.

Figure 6:
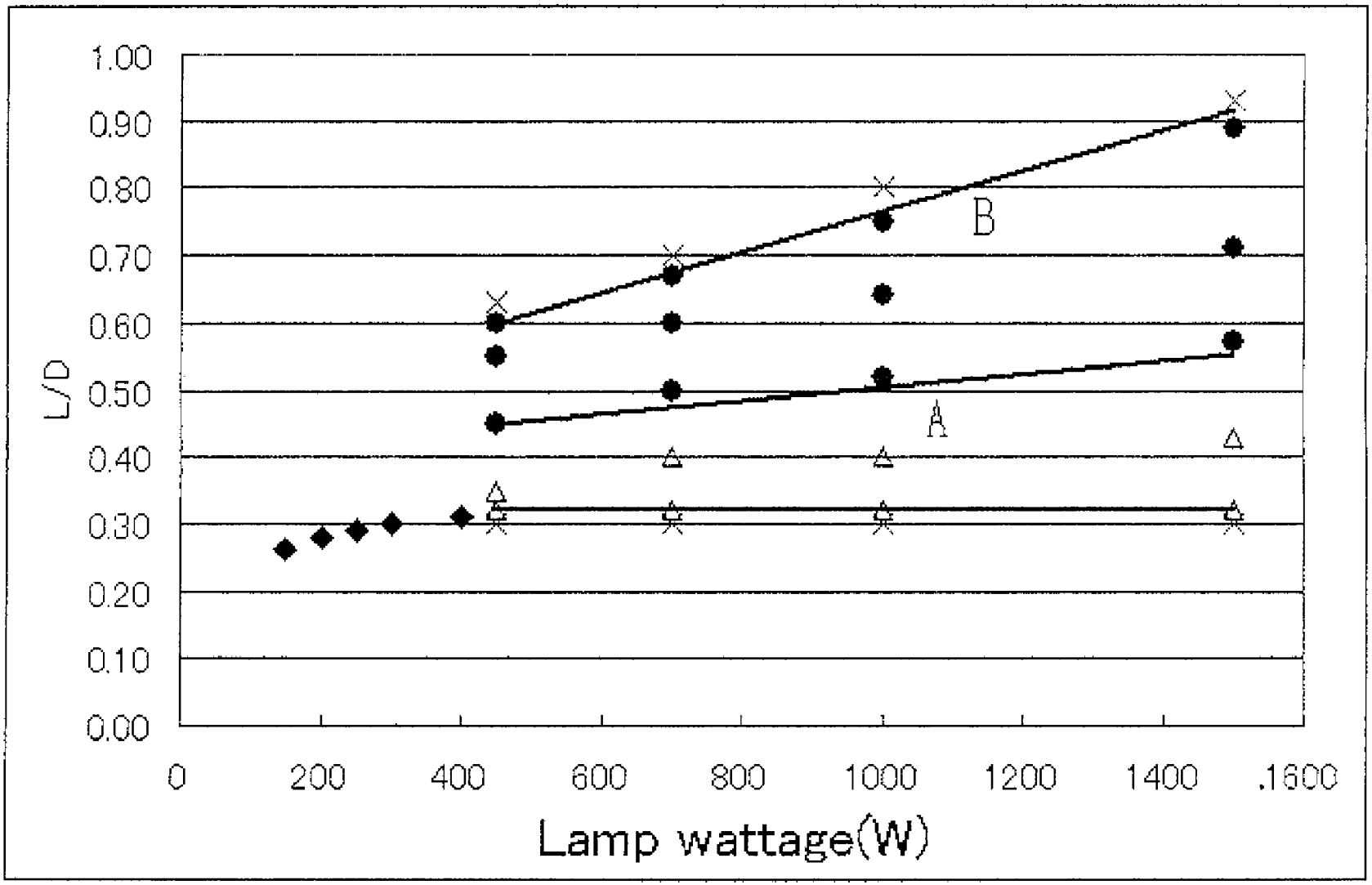
FIG. 6 is a graph showing performances compared between Examples of the present invention and Comparative Examples, in which the horizontal axis represents lamp output, and the vertical axis represents L/D.

The results of the above Examples are summarized in FIG. 6. In FIG. 6, the case where completely no flicker is observed, and no blacking is observed in the arc tube is represented by "●", the case where almost no flicker is observed and no blacking is observed in the arc tube is represented by "Δ", and the case where flicker is observed or early blacking occurs is represented by "x". Further, a relationship between lamp wattage employed in our ceramic metal halide lamp having a rated lamp wattage of not more than 400 W and L/D is represented by "◆".

The line B in FIG. 6 represents the upper limit of the range where early blacking does not occur in the present invention, and is represented by $L/D=0.0003\times W+0.465$. The line A represents the lower limit of the range where completely no flicker occurs in the present invention, and is represented by $L/D=0.0001\times W+0.405$.

As can be seen from the chart, it had been expected before the present invention was made that an appropriate L/D is about 0.3 even when the lamp wattage is more than or equal to 450 W from the relationship between the lamp wattage and L/D in our ceramic metal halide lamp having a rated lamp wattage of not more than 400 W. Therefore, in a ceramic metal halide lamp having a rated lamp wattage of greater than or equal to 450 W, the above results that L/D should be 0.32 or greater because the lamp is unusable because of occurrence of flicker at L/D of 0.3 is an unexpected result which is inconceivable from extension of the conventional art.

Further, since completely no flicker occurs in a ceramic metal halide lamp of greater than or equal to 450 W, the most practicable range of L/D is between $0.0001\times W+0.405$ and $0.0003\times W+0.465$, inclusive. This most practicable range largely differs from a preferred value of L/D for a lamp of greater than or equal to 450 W that can be expected from a relationship between the lamp wattage and L/D in our ceramic metal halide lamp having a rated lamp wattage of not more than 400 W. Therefore, it can be understood that the above result is quite an inconceivable result.

In a ceramic metal halide lamp having a rated lamp wattage of not more than 400 W, flicker will not occur even when L/D is changed to some extent from a usually used range. The flicker described above becomes problematic only when the rated lamp wattage is greater than or equal to 450 W. That is, the present invention solves the problem of easy occurrence of flicker which is peculiar to a rated lamp wattage of greater than or equal to 450 W.

It was also found that when the value of L/D is made greater than 0.32 in a lamp having a rated lamp wattage of not more than 400 W, characteristics is deteriorated because vapor pressure of a metal halide fails to rise sufficiently.

Although Tm, Ho and Dy were used as rare-earth metals in Examples, a similar tendency was obtained with other rare-earth metals such as La, Ce, Pr, Nd, Eu, Gd, Tb, Er, Tb, and Lu. It was found that the preferred enclosing amount of the rare-earth metal halide is 0.2 to 4.0 μmol/cc. If the amount is smaller than the range, sufficient emission of the rare-earth metal is not obtained, and efficacy and color rendering are poor. If the amount is larger than the range, there arise the problems that flicker is likely to occur, and that part of the rare-earth metal halide adheres to the inner face of the main tube 1 and absorbs light, so that efficacy is deteriorated.

In addition, characteristically good results were obtained when alkaline earth metals such as Li or Ca, Sr, Ba was added. Since these metals have the effect of stabilizing arc likewise Na, adding these metals facilitates prevention of flicker.

Quartz is inferior in heat resistance to ceramics. Therefore, when quartz is used as a material of the arc tube, a usually used bulb wall loading and the temperature range of the arc tube are very low compared to the case where a ceramic is used as a material of the arc tube. As a result, circumstances such as likelihood of occurrence of flicker and blacking is completely different from that of the case where a ceramic is used. Therefore, the effect of the present invention may not be obtained when quartz is used instead of a ceramic as a material of the arc tube.

The present application is based on a Japanese patent application, filed on Feb. 17, 2005 (Japanese Patent Application No. 2005-041009), and the context thereof is incorporated herein by reference.

INDUSTRIAL APPLICABILITY

According to the first aspect of the present invention, even in a ceramic metal halide lamp having a rated lamp wattage of greater than or equal to 450 W, effects are obtained that almost no flicker occurs, and early blacking does not occur in the arc tube.

According to the second aspect of the present invention, in a ceramic metal halide lamp having a rated lamp wattage of greater than or equal to 450 W, effects are obtained that completely no flicker occurs, and early blacking does not occur in the arc tube.

The invention claimed is:

1. A metal halide lamp comprising:

a translucent ceramic arc tube enclosure including:

a main tube inside which a discharge space is formed; and two narrow tubes having smaller diameter than the main tube, each connected to either end of the main tube;

two electrodes; and a metal halide provided inside the arc tube enclosure, wherein one of the two electrodes is disposed so that it protrudes inside the main tube from inside of one of the two narrow tubes, wherein the other one of the two electrodes is disposed so that it protrudes inside the main tube from the other one of the two narrow tubes, wherein when the rated lamp wattage is denoted by W (watt), an inside diameter of the main tube by D (mm), an electrode protruding length which is the distance from boundary between the main tube and the narrow tubes to an end of the electrode by L (mm), and the distance between ends of the two electrodes by E (mm), wherein a bulb wall loading G (watt/$cm^2$) represented by $G=W/(3.14\times D\times E\times 0.01)$ falls within the range of $15\leqq G\leqq 40$, wherein a relationship $0.0001\times W+0.405\leqq L/D\leqq 0.0003\times W+0.465$ is established, and wherein the metal halide lamp has a rated lamp wattage between 450 W and 1500 W.

2. The metal halide lamp according to claim 1, wherein the metal halide contains 0.2 to 4.0 μmol/cc of a rare-earth metal halide.

3. The metal halide lamp according to claim 1, wherein the metal halide contains 0.2 to 4.0 μmol/cc of a rare-earth metal halide.

4. The metal halide lamp according to claim 1, wherein a relationship $$0.0096\times W+13.28\leqq D\leqq 0.0104\times W+19.72$$

is established between the D and the W.

* * * * *